United States Patent [19]

Klein

[11] Patent Number: 4,852,628

[45] Date of Patent: Aug. 1, 1989

[54] SUSPENSION SYSTEM FOR FOLDING DOOR

[75] Inventor: Arno Klein, Hirz-Maulsbach, Fed. Rep. of Germany

[73] Assignee: Labex GmbH, Bundesrepublic, Fed. Rep. of Germany

[21] Appl. No.: 43,087

[22] Filed: Apr. 27, 1987

[51] Int. Cl.[4] ..... E05D 15/26

[52] U.S. Cl. ..... 160/199; 160/206; 160/118

[58] Field of Search ..... 160/199, 206, 207, 196 R, 160/196 D, 331; 49/409, 410, 411, 412; 16/87.2, 87.8, 87 R, 87.4, 87.6, 95 R, 95 D, 96 R, 96 D, 94 R, 94 D

[56] References Cited

U.S. PATENT DOCUMENTS

| | | | |
|---|---|---|---|
| 1,054,376 | 2/1913 | Weidrich | 16/95 R |
| 1,294,589 | 2/1919 | Wolfe | 16/95 R |
| 2,922,183 | 1/1960 | Taylor | 16/87 R |
| 3,035,275 | 5/1962 | Strebeigh . | |
| 3,098,519 | 7/1963 | Myers et al. | 160/199 X |
| 3,321,003 | 5/1967 | Boerner . | |
| 3,372,599 | 3/1968 | Bratschi | 160/331 X |
| 3,392,420 | 7/1968 | Kless | 16/94 D X |
| 4,083,395 | 4/1978 | Romano . | |
| 4,274,467 | 6/1981 | Comeau . | |
| 4,289,190 | 9/1981 | Catan . | |
| 4,335,777 | 6/1982 | Simon . | |
| 4,355,678 | 10/1982 | Romano . | |
| 4,388,961 | 6/1983 | Schaefer . | |
| 4,449,270 | 5/1984 | Barbant . | |
| 4,476,652 | 10/1984 | Beauchot | 49/410 X |
| 4,651,469 | 3/1987 | Ngian et al. | 49/409 X |
| 4,680,828 | 7/1987 | Cook et al. | 16/94 R X |

FOREIGN PATENT DOCUMENTS

| | | |
|---|---|---|
| 3048763 | 9/1983 | Fed. Rep. of Germany . |
| 1554159 | 10/1979 | United Kingdom . |
| 2080379 | 2/1982 | United Kingdom . |

*Primary Examiner*—Ramon S. Britts
*Assistant Examiner*—David M. Purol
*Attorney, Agent, or Firm*—Foley & Lardner

[57] ABSTRACT

A suspension system for a heavy duty industrial door has a double guide track system which provides smoother operation and resistance to jamming due to the effects of wind or negative air pressure. Respective guide tracks can be disposed at 90° angles, and a similarly designed support carriage having a pair of traveling support devices disposed at right angles engage each of the guide tracks for supporting associated sections of a flexible door. The suspension system according to the invention is particularly adapted for use with folding industrial doors which comprise a series of overlapping flexible plastic strips which depend from hinged rack sections.

18 Claims, 4 Drawing Sheets

SUSPENSION SYSTEM FOR FOLDING DOOR

TECHNICAL FIELD

This invention relates to an improved suspension system for a folding door or curtain, particularly a movable overhead support system for a heavy duty industrial folding door.

BACKGROUND OF THE INVENTION

A variety of suspension systems for folding doors and curtains are known. Such systems suspend the curtain or folding door in a hung position, and include means for opening and closing the curtain or door by movement of the suspension system in an essentially horizontal direction. In general, the design of such overhead suspension systems varies with the intended application, particularly the size and weight of the curtain or folding door. For example, a simple shower curtain can be suspended from a horizontal bar by a series of sliding hooks or loops. See, for example, Strebeigh U.S. Pat. No. 3,035,275 issued May 22, 1962, and Boerner U.S. Pat. No. 3,321,003 issued May 23, 1967. For heavier doors or curtains, more elaborate hanging systems, e.g. traverse rods, have been proposed.

Industrial doors comprising a series of adjacent flexible plastic strips suspended from a doorway are generally known. See, for example, Catan U.S. Pat. No. 4,289,190 issued Sept. 15, 1981, Barbant U.S. Pat. No. 4,449,270 issued May 22, 1984, Schaefer U.S. Pat. No. 4,388,961 issued June 21, 1983, Romano U.S. Pat. No. 4,355,678 issued Oct. 26, 1982, Simon U.S. Pat. No. 4,335,777 issued June 22, 1982, and Sills U.K. Patent Application No. 2,080,379 published Feb. 3, 1982.

For industrial doors including a series of overlapping strips or hinged sections which draw to one side in a fan-folded position, typical suspension systems include a series of rack sections connected to each corresponding section of the curtain or door secured to suitable means for effecting a fan-fold opening and closing movement. Each rack section can be connected to an overhead guide track by a series of pins pivotally connected to rollers, as illustrated by Romano U.S. Pat. No. 4,083,395 issued Apr. 11, 1978. In lieu of rollers, simple sliding support devices can be employed, such as described in Sandall U.K. Patent Specification No. 1,554,159 published Oct. 17, 1979. The wheels or support devices are typically interlocked with the guide track. Comeau U.S. Pat. No. 4,274,467 fold type drapery suspension system.

One known design for an industrial door of the strip type combines the advantages of an overhead suspension system including a series of hinged, fan-foldable rack sections with a means for automatically opening and closing the door. The present inventor proposed such a system in German Patent No. 3,048,763 published Sept. 6, 1983, the features of which are illustrated in FIGS. 1, 2 and 3 of the present application. The entire contents of the German Patent No. 3,048,763 are hereby expressly incorporated herein by reference.

As shown in FIGS. 1–3, a known folding door includes a series of flexible transparent strips 1 having overlapping edge portions 1A each attached to a rack 3 consisting of jointed sections 4, 5 and 6 which can be folded along a guide track 7. Section 4 located nearest the doorway edge is linked to a bearing bolt 9 below guide track 7. The free end 4A of rack section 4 is joined to a second rack section 5 of double length which is attached at its center by a swivel joint 10 and support rod 11 to a carriage 12 which comprises a vertically oriented plate having a series of rollers 12A mounted thereon. Rollers 12A engage the inner periphery of guide track 7, as illustrated in FIG. 3.

Second rack section 5 has an end 5A connected to third rack section 6 which moves in parallel with first rack section 4. End portion 6A of rack section 6 is attached by a swiveling joint 13 and support rod 14 to carriage 15.

A draw cable assembly 16 and a pair of draw rods 17A, 17B are disposed above guide track 7 and are connected to support rods 14 of each rack 3. Sprocket chains 18, 19 connected to draw rods 17A, 17B are guided by sprocket wheels 20, 21, at least one of which is powered by a motor (not shown) to turn in either direction to open and close the door, respectively.

Hinge pins 23 of hinges 22 connecting respective rack sections 4, 5 and 6 are offset relative to an imaginery vertical longitudinal plane bisecting rack sections 5, 6. This allows sections 4, 5, 6 to fold parallel to each other in the manner shown in FIG. 3. Hinge connections 22 may further have spring biased studs 25 which protrude from the end of at least one of each two adjoining sections 4, 5 and 5, 6 which assist hinging by exerting pressure on abutment end surface 26 of rack section end 5A, as illustrated in FIG. 3.

The track system described above in connection with the folding door illustrated in FIGS. 1 through 3 has several shortcomings. Performance of such a door, particularly when installed at a doorway to the outdoors, suffers due to high winds or negative air pressure. Specifically, the wind or air pressure may push the door so that it hangs at an angle partially supported by the wind or air pressure, i.e. at an angle to its normal perpendicular position relative to the floor. When this happens, carriage 12, particularly rollers 12A, pivot within guide track 7, increasing friction when the door is opened and closed, in some cases jamming the door.

The foregoing known automatic door system is also quite limited in the number of frame sections which can be employed, in other words, the total length of rack 3. In general, to function smoothly, the foregoing door should have no more than about six rack sections 4, 5, 6 total, three per site, each rack section 4–6 having a length of thirty inches or less. If additional rack sections are added, or the rack sections 4–6 are lengthened beyond thirty inches, friction increases to the point where it becomes difficult to drive the suspension system between opened and closed positions.

The present invention provides a track system for a heavy duty flexible industrial door which can overcome some of the aforementioned drawbacks of known track suspension systems.

SUMMARY OF THE INVENTION

A track suspension system according to the invention includes a first elongated guide track, a second elongated guide track disposed parallel to the first track, a support carriage, a hinge connected to the support carriage, and a rack pivotally connected by the hinge to the carriage for supporting a suspended object, such as a flexible strip of a folding door. The support carriage includes a frame, a first traveling support device disposable in the first guide track for allowing movement of the carriage along the first guide track, and a second traveling support device which rides in the second guide track in unison with the first traveling support device. Such a system having at least two guide tracks disposed in parallel, together with a support carriage which is disposed for simultaneous movement along both tracks, provides a suspension system much less likely to malfunction under the strain of added weight or air pressure.

BRIEF DESCRIPTION OF THE DRAWING

The invention will be further described with reference to the appended drawing, wherein like numerals denote like elements, and.

DETAILED DESCRIPTION OF A PREFERRED EXEMPLARY EMBODIMENT

Figure 1:
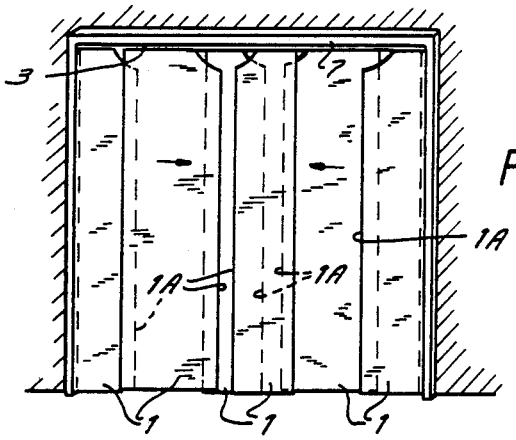
FIG. 1 PRIOR ART
FIG. 1 is a front, elevational view of a folding door according to the prior art.
Figure 2:
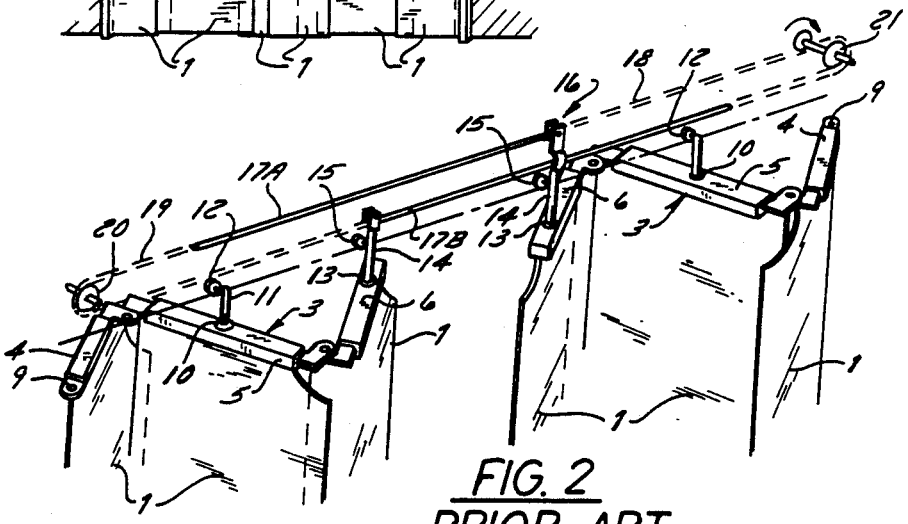
FIG. 2 PRIOR ART
FIG. 2 is a partial, perspective view of a suspension system for the folding door of the prior art shown in FIG. 1.
Figure 3:
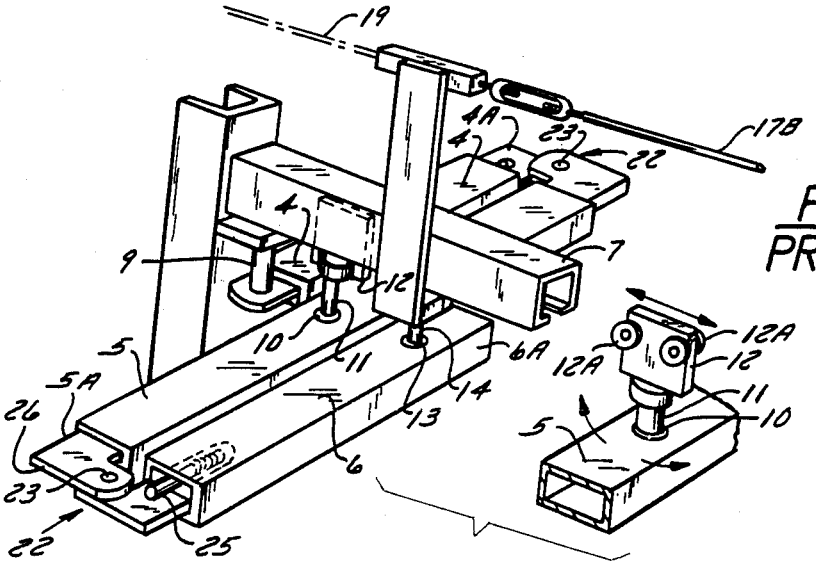
FIG. 3 PRIOR ART
FIG. 3 is an enlarged, partial perspective view of the suspension system of the prior art shown in FIG. 2.

As previously described, FIGS. 1 to 3 illustrate a known folding door having an overhead tracking suspension system. The foregoing detailed description is incorporated by reference herein insofar as the present invention has features in common with the foregoing known folding door and tracking system. As to elements for which like reference numerals are used, the present description incorporates the preceding description herein by reference.

Figure 4:
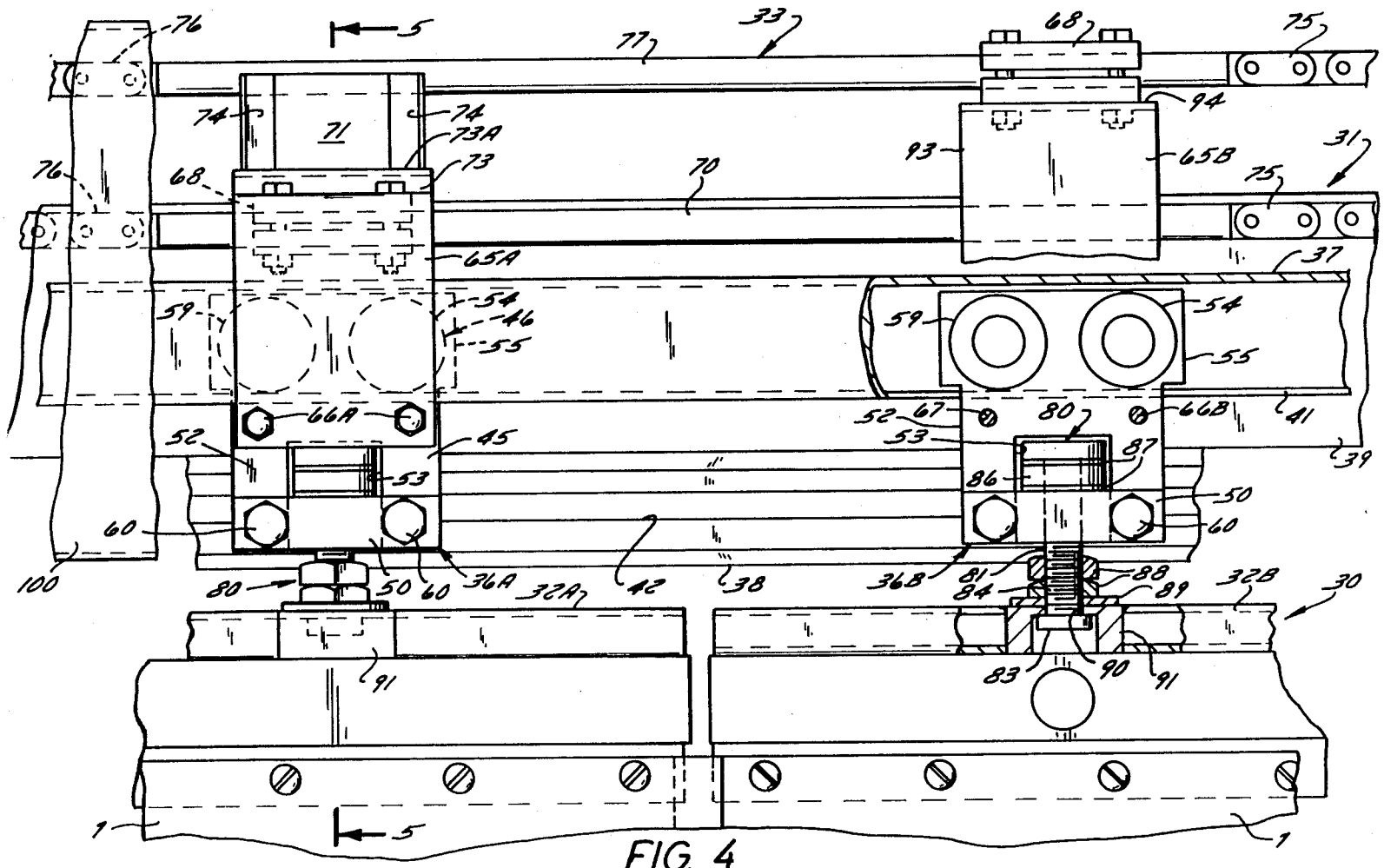
FIG. 4 is a partial, front view of a folding door according to the present invention, partly broken away.

FIGS. 4 through 7 illustrate an embodiment of a folding door 30 according to the present invention including an overhead, reciprocating suspension system 31, a pair of left and right racks 32A, 32B, respectively, and a series of flexible strips 1. Suspension system 31 includes, as major components, a plurality of support carriages 36 which travel along a pair of respective first and second elongated guide tracks 37, 38 secured to a horizontal beam 39 such as a doorway, and a drive system 33 (means) for effecting movement of carriages 36 along tracks 37, 38. FIG. 4 shows a left inner support carriage 36A and a right inner support carriage 36B.

Figure 6:
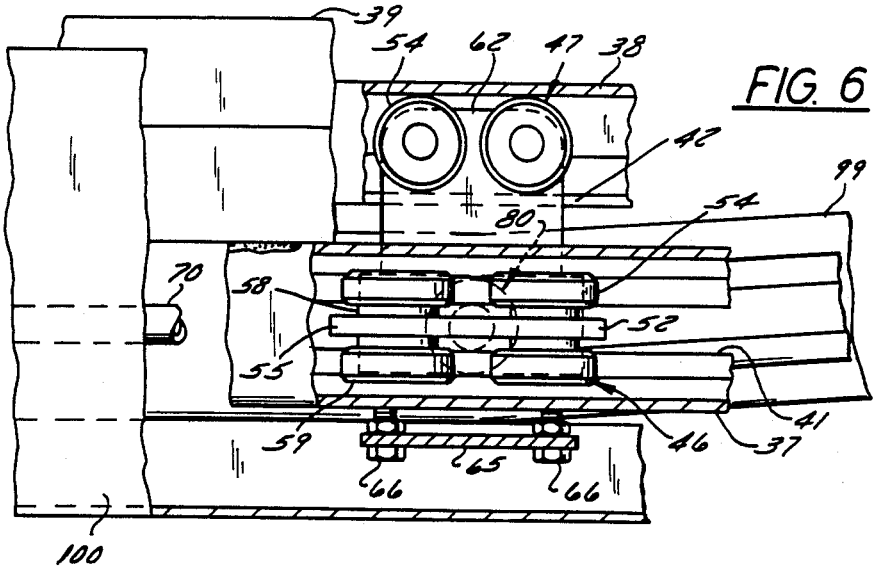
FIG. 6 is a top, plan view, partly broken away, taken along the line 6—6 in FIG. 5.
Figure 5:
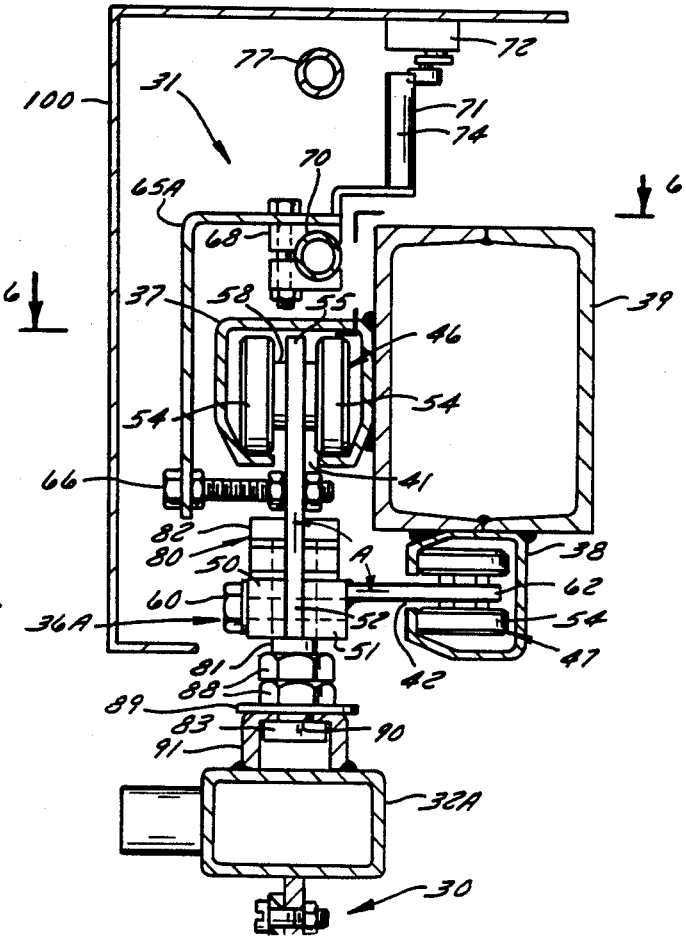
FIG. 5 is a cross-sectional view taken along the line 5—5 in FIG. 4.

FIG. 4 through 6 illustrate in detail the structure of overhead suspension system 31. First and second parallel hollow guide tracks 37, 38 are disposed horizontally on a doorway 39 or similar support surface, preferably on two adjacent, mutually perpendicular faces thereof as shown in FIG. 5. Each guide track 37, 38 comprises a hollow, generally rectangular rail having an opening 41, 42, respectively, extending along the length thereof. Guide tracks 37, 38 are secured to the associated respective vertical and lower horizontal walls of doorway 39 by any suitable means, such as welding. Opening 41 of guide track 37 opens downwardly, and opening 42 of guide track 38 opens sideways towards guide track 37 as shown in FIG. 5. Guide tracks 37, 38 will generally span most or all of the width of the doorway. Guide track 38, which opens sideways, is preferably positioned so that it is offset both horizontally and vertically from guide track 37, for reasons described hereafter.

Left inner carriage 36A comprises a frame 45 having a pair of first and second traveling support devices 46, 47 respectively secured thereto. In the illustrated embodiment, frame 45 comprises a pair of horizontally elongated, matching front and rear bars 50, 51, respectively disposed on opposite ides of a central, vertically elongated plate 52. Plate 52 has a downwardly opening rectangular groove 53 therein and a pair of conventional, double wheeled track rollers 54 rotatably mounted at a widened, upper end portion 55 thereof. Track rollers 54 comprise axles 58 which penetrate suitable holes through plate 52 and pairs of identical wheels 59 disposed on opposite sides of plate 52 for rotation on opposite end portions of axles 58. A pair of bolts 60 penetrate aligned holes on opposite sides of groove 53 to rigidly unite bar 50, plate 52 and bar 51.

First traveling support device 46 comprises upper end portion 55 of plate 52, together with track roller assemblies 54. Second traveling support device 47 comprises a laterally extending plate 62 having a further pair of track roller assemblies 54 mounted thereon, preferably in the same manner as for first traveling support device 46. Plate 62 is secured endwise directly to a rear face of bar 51 by any suitable means, such as welding.

First and second traveling support devices 46, 47 are oriented to ride in first and second guide tracks 37, 38, respectively, as shown in FIG. 5. First guide track 37 and corresponding first traveling support device 46 are disposed vertically for supporting a major part of the weight of folding door 30. As best seen in FIGS. 5 and 6, track rollers 54 of first support device 46 are disposed for traveling engagement with an upward facing guide surface of first guide track 37. Second guide track 38 and corresponding second traveling support device 47 are preferably oriented horizontally (sideways) for guiding carriages 36 and maintaining track rollers 54 in proper alignment with their associated guide tracks. Track rollers 54 of second traveling support device 47 are disposed between opposing interior vertical guide surfaces of second guide track 38, for traveling engagement therewith. It is preferred that first and second traveling support devices be disposed at an included angle A of about 90°, so that the surfaces of existing, rectilinear structures such as doorways or beams can be used for mounting overhead suspension system 31. However, for purposes of guiding and aligning carriages 36, it is sufficient to position first and second traveling support devices 46, 47 so that the included angle A defined between the respective lengthwise axes thereof is greater or less than 90°, e.g. as little as 30° or as much as 150°. The positions of guide tracks 37, 38 are adjusted accordingly.

Track rollers 54 may be replaced by any suitable traveling devices, such as, for example, nylon skids which slide along the inner surfaces of the associated guide tracks. Such skids may especially be employed as part of the traveling support device 47 which is generally horizontally oriented and therefore subjected to less strain than the vertically oriented first traveling support device 46.

A generally L-shaped bracket 65 is secured to a central portion of plate 52 by a pair of nut and bolt assemblies 66 disposed in holes 67 in plate 52. For purposes of compactness, holes 67 are preferably positioned between traveling support device 46 and groove 53 in plate 52. Bracket 65 has a clamp 68 connected thereto which rigidly secures it to a traveling rod 70. An upright limit switch dog 71 is disposed on a top horizontal surface of a horizontal wall 73 of bracket 65. Dog 71 may be positioned on a raised step portion 73A, if necessary to ensure clearance over beam or doorway 39. Dog 71 extends upwardly and has a pair of angled sidewalls 74 which engage a suitable limit switch mechanism 72 when the door is in an open position.

Clamp 68 secures carriage 36A for horizontal movement in unison with a lower traveling rod 70. Rod 70 is connected by a right drive chain 75 to a motor driven sprocket wheel 21. Lower traveling rod 70 is also connected at its left end to a left drive chain 76 connected to a corresponding sprocket wheel 20. Chains 75, 76 are similarly connected to opposite ends of an upper traveling rod 77 associated with right carriage 36B as described hereafter.

A cylindrical hinge 80 connects each rack section 32 to its corresponding carriage 36. Hinge 80 comprises hinge pin 81 having a pair of enlarged upper and lower annular end flanges 82, 83, respectively, and a lower threaded end portion 84 adjoining lower hinge 83. Upper flange 82 of pin 81 is disposed in rectangular groove 53 of plate 52 above bars 50, 51. Upper flange 82 may be retained in groove 53 by abutment of upper flange 82 with upper walls of bars 50, 51. In the illustrated embodiment, a washer 86 and a pair of annular bearings 87 are interposed between annular upper flange 82 and the upper surfaces of bar 50, 51 to facilitate free pivoting of hinge 80. A pair of spacer nuts 88 and a washer 89 are disposed on threaded portion 84 of hinge pin 81, as shown, in order to clamp hinge 80 for rotation with associated rack 32A. Rack 32A has a hole 90 through which hinge pin 81 penetrates an a hollow upper rack section 91 in which lower annular flange 83 of hinge pin 81 is disposed.

Carriage 36B shown in FIG. 4 is essentially identical to carriage 36A to its left, except as follows. In carriage 36B, L-shaped bracket 65B has a lengthened vertical wall 93 so that its corresponding horizontal wall 94 extends in close proximity to the lower surface of upper traveling rod 77. A second clamp 68 mounted on the upper surface of wall 94 rigidly secures carriage 36B by its associated bracket 65 to traveling rod 77. Limit switch dog 71 and step portion 73A are omitted.

Figure 7:
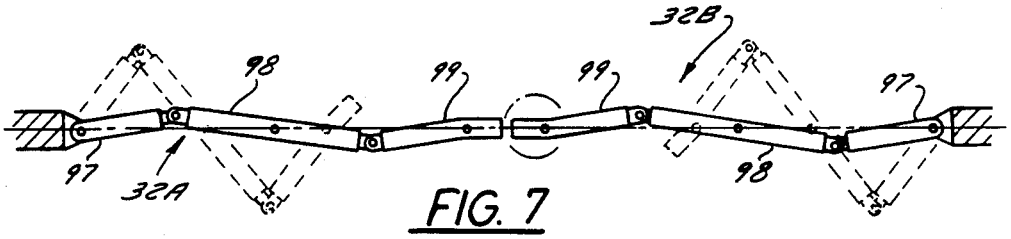
FIG. 7 is a top, plan view of the rack described in FIGS. 4–6.
Figure 8:
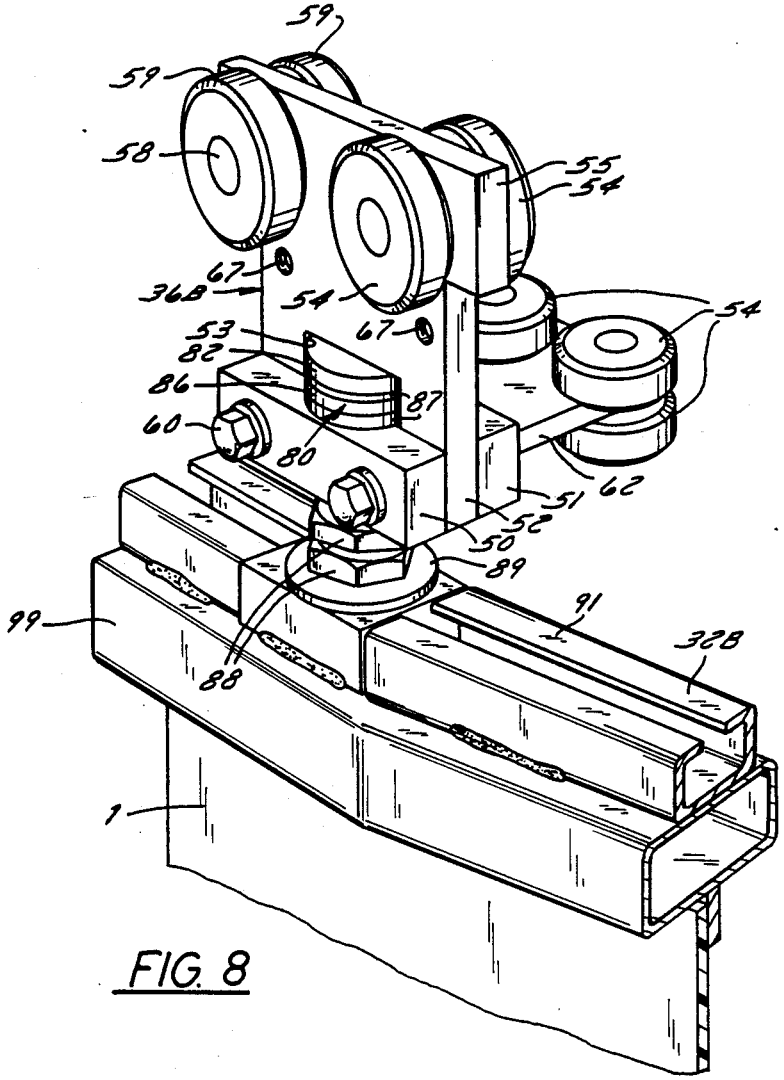
FIG. 8 is a perspective view of a support carriage and rack section circled in FIG. 7.

Rack structure 3 described above is suitable for use in the present invention, and may be modified to include more than three jointed sections 4–6 per rack 3 due to the additional stability of the suspension system 31 according to the invention. For example, ten or more such joint sections may be employed, and the length of each section may be as great as 45 inches. In particular, as illustrated in FIG. 7, individual joint sections 97, 98, 99 according to the invention may each have lengths exceeding 30 inches, particularly 31 to 45 inches. This is a significant improvement over the maximum door sizes permitted by the overhead suspension system of the foregoing German Patent No. 3,048,763. The suspension system 31 of the foregoing embodiment is particularly well adapted for heavy duty, industrial doors wherein the size and weight of racks 32A, 32B and the associated strips 1 is great. A removable hood 100 may optionally be used to cover suspension system 31.

Innermost carriages 36A and 36B include additional structures, i.e. brackets 65A, 65B and parts associated therewith, for connecting carriages 36A, 36B to respective traveling rods 70 and 77 so that the resulting folding door 30 may be opened and closed automatically in a fanfold or accordion-like fashion. Outer carriages 36 (not shown) supporting inner frame sections 96, 97 are essentially identical to carriages 36A, 36B, except that the additional structure, i.e. brackets 65A, 65B, is omitted. Support carriages 36 may thus be readily manufactured for service either in an inner or outer position.

Folding door 30 operates as follows. When door 30 is in the closed position, left and right door sections 30A, 30B, respectively, assume the solid position shown in FIG. 7. Carriages 36A, 36B are fully extended along the length of guide tracks 37, 38 so that they assume the position shown in FIG. 4. To open the door, the motor driving the sprocket wheels 20, 21 and associated drive trains 75, 76 is actuated by any suitable means, such as a wall-mounted button or radio-control unit. This causes rod 70 to move left and rod 77 to move right from their respective positions shown in FIG. 4. Movement of rods 70, 77 causes carriages 36A, 36B to move in opposite directions along guide tracks 37, 38. During such movement door sections 30A, 30B assume the partially closed position shown by dotted lines in FIG. 7. Cycling of folding door 30 ends when dog 71 contacts limit switch unit 72 near the side of the doorway. When the motor is cycled again, its direction of rotation is reversed so that folding door 30 returns to the position shown in FIG. 4. The described suspension system 31 allows folding door sections 30A, 30B to close smoothly even when subjected to strong winds or negative air pressure.

It will be understood that the above description is of a preferred exemplary embodiment of the invention, and that the invention is not limited to the specific form shown. Modifications may be made in the described elements without departing from the scope of the invention as expressed in the appended claims.

I claim:

1. A suspension system for a folding door, comprising:

a first elongated generally horizontal guide track having a generally horizontal guide surface;

a support carriage disposed for movement along said first guide track;

a hinge pivotally supported on said carriage and a rack for supporting a suspended door panel connected by said hinge to said carriage, said rack being configured to pivot about said hinge in a substantially horizontal plane;

a second elongated guide track, having first and second opposing guide surfaces, disposed parallel to said first guide track in a position horizontally and vertically offset therefrom;

wherein said support carriage includes a first traveling support device for traveling engagement with said generally horizontal guide surface, and a second traveling support device disposed in interlocking relationship with said second guide rack proximate said first and second guide surfaces, for effecting simultaneous movement of said carriage along both of said guide tracks.

2. The suspension system of claim 1, wherein said first and second guide tracks are secured to substantially coterminous adjoining faces of a generally horizontal beam along the top of a doorway, said beam being generally rectilinear in cross-section.

3. A suspension system for a folding door, comprising:

a first elongated guide track secured to a first face of a generally horizontal beam along the top of a doorway, said first guide track having a generally horizontal guide surface;

a second elongated guide track secured to a second face of the doorway, said second face being substantially coterminous with said first face, wherein said second track is disposed in a position horizontally and vertically offset from said first guide track, said second guide track having first and second oppositely disposed guide surfaces;

a support carriage, including a frame, a first traveling support device disposed in said first guide track and engaging said generally horizontal guide surface, for allowing movement of said carriage along said first guide track, and a second traveling support device disposed in interlocking relationship with said second guide track proximate said first and second guide surfaces, for allowing movement of said carriage along said second guide track;

a hinge pivotally supported on said frame of said carriage; and rack means connected by said hinge to said carriage for supporting a suspended object.

4. A suspension system for a folding door, comprising:

a first, elongated guide track, having a generally horizontal guide surface, secured to a first face of a generally horizontal beam along the top of a doorway;

a second, elongated guide track having first and second opposing guide surfaces disposed transverse to said horizontal guide surface, said second guide track being secured to a second face of the doorway, said second face being substantially coterminous with said first face, wherein said second track is disposed in a position horizontally and vertically offset from said first guide track;

a support carriage, including a frame having a hinge pivotally supported thereon, a first traveling support wheel, configured for traveling engagement with said horizontal guide surface, for allowing movement of said carriage along said first guide track, and a second traveling support wheel disposable in said second guide track intermediate said first and second opposing guide surfaces for allowing movement of said carriage along said second guide track, wherein said first and second traveling support devices each comprise a rigid plate for mounting said wheels, and wherein said frame comprises an elongated plate having a groove therein in which a hinge pin of said hinge is disposed; and rack means connected by said hinge to said carriage for supporting a suspended door panel.

5. The suspension system of claim 4, wherein said plates of said first and second traveling support devices define therebetween an included angle in the range of 30° to 150°.

6. The suspension system of claim 4, wherein said plates define an included angle of about 90° therebetween.

7. The suspension system of claim 4, further comprising a pair of bars clamped to opposite faces of said frame over a lower end portion of said groove, said bars supporting said hinge pin.

8. The suspension system of claim 7, wherein said plate of said second traveling support device is secured to one of said bars.

9. The suspension system of claim 4, further comprising drive means secured to said carriage for effecting movement of said carriage along said guide tracks, a bracket secured to said plate of said carriage, and a clamp secured to said bracket for clamping said drive means to provide unison movement of said carriage and said drive means.

10. The suspension system of claim 9, wherein said bracket has an upright limit switch dog mounted on a horizontal upper wall thereof, and said drive means includes a limit switch mechanism engagable by said dog.

11. The suspension system of claim 8, wherein said plate of said first traveling support device comprises an upper end portion of said plate of said frame.

12. The suspension system of claim 11, further comprising a plurality of holes for mounting said bracket to said plate of said frame disposed between said upper end portion of said plate of said frame and said groove in said plate in which said hinge is disposed.

13. A folding door, comprising:

a first elongated guide track having a first, generally horizontal guide surface;

a second elongated guide track, having a pair of second opposing guide surfaces disposed transverse to said first guide surface, said second track being disposed parallel to said first guide track;

a plurality of support carriages in interlocking relationship with said first and second guide tracks and being disposed for for movement along said guide tracks, each of said support carriages including a frame, a first traveling support device, disposed within said first guide track for traveling engagement with said first guide surface, for allowing movement of said carriage along said first guide track, and a second traveling support device disposed in interlocking relationship with said second guide track, intermediate said second opposing guide surfaces, for allowing movement of said carriage along said second guide track;

a plurality of hinges each connected to said frame of each respective carriage;

a plurality of rack sections pivotally connected by each of said hinges to respective carriages, said racks being configured to pivot in a substantially horizontal plane;

a plurality of flexible elongated strips depending from said sections;

drive means operatively connected to at least one of said support carriages for effecting movement of said carriages along said guide tracks between an open position at which said carriages are drawn together towards one end portion of said guide tracks, and a closed position at which said carriages are spaced apart along essentially the entire length of said guide tracks; and means for selectively actuating said drive system.

14. The folding door of claim 13, wherein said second guide track is disposed in a position horizontally and vertically offset from said first guide track.

15. The folding door of claim 14, wherein said first and second traveling support devices each comprise a rigid plate having a wheel rotatably mounted thereon for engagement against the associated guide surface.

16. The suspension system of claim 15, wherein said plates of said support devices define an included angle of about 90° therebetween.

17. The suspension system of claim 15, wherein said frame comprises an elongated plate having a groove therein in which a hinge pin of one of said hinges is disposed.

18. The suspension system of claim 17, further comprising a pair of bars clamped to opposite faces of said frame over a lower end portion of said groove, said bars supporting said hinge pin.

* * * * *